US007036467B2

(12) United States Patent
Kassner

(10) Patent No.: US 7,036,467 B2
(45) Date of Patent: May 2, 2006

(54) METHOD AND DEVICE FOR ADJUSTING VARIABLE COMPRESSION IN A COMBUSTION ENGINE

(75) Inventor: Uwe Kassner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/833,847

(22) Filed: Apr. 27, 2004

(65) Prior Publication Data

US 2004/0216704 A1 Nov. 4, 2004

(30) Foreign Application Priority Data

May 2, 2003 (DE) ..... 103 19 666

(51) Int. Cl.
*F02D 15/02* (2006.01)

(52) U.S. Cl. ..... 123/48 B

(58) Field of Classification Search ..... 123/48 R, 123/48 A, 48 AA, 48 B, 48 C, 48 D, 78 R, 123/78 A, 78 AA, 78 B, 78 BA, 78 C, 78 D, 123/78 E, 78 F See application file for complete search history.

(56) References Cited

U.S. PATENT DOCUMENTS 6,588,384 B1 7/2003 Yapici
6,665,605 B1 * 12/2003 Boyer et al. ..... 123/78 E
6,666,177 B1 12/2003 Stiebels et al.

FOREIGN PATENT DOCUMENTS

DE 199 50 682 A1 4/2001
DE 100 51 271 A1 4/2002
JP 64-35030 A * 2/1989

* cited by examiner

*Primary Examiner*—Andrew M. Dolinar
(74) *Attorney, Agent, or Firm*—Michael J. Striker

(57) ABSTRACT

A method for operating a combustion engine (10) with a variable compression ratio includes the following steps: determining a theoretical value for the compression ratio; adjusting the compression ratio to the theoretical value; and correcting the adjusted compression ratio as a function of signals of a sensor mechanism of the combustion engine (10). The step of correcting includes the step of determining an actual value of the compression ratio. In addition, a device for performing the method is proposed.

3 Claims, 3 Drawing Sheets

METHOD AND DEVICE FOR ADJUSTING VARIABLE COMPRESSION IN A COMBUSTION ENGINE

BACKGROUND OF THE INVENTION

The present invention relates to a method for operating an internal combustion engine with a variable compression ratio with the following steps: determining a theoretical value for the compression ratio; adjusting the compression ratio to the theoretical value; and correcting the adjusted compression ratio as a function of signals of a sensor mechanism of the combustion engine.

In addition, the present invention relates to a device for operating an internal combustion engine, which has at least one controller for adjusting a variable compression ratio to a theoretical value and a sensor mechanism, which is sensitive to changes of the compression ratio.

Such a method and device are known from DE 199 50 682 A1.

Methods for operating a multi-cylinder combustion engine with a variable compression ratio, as well as a control apparatus for controlling the method, are known, respectively, from DE 100 51 271.

These documents show a combustion engine, whose crankshaft is not supported directly in an engine block. Instead, the crankshaft is supported in eccentric rings, which are rotatably supported in support bearings in the engine block. With the aid of an adjustment mechanism, the eccentric rings can be rotated in a controlled manner. With rotation of the eccentric rings, the position of the crankshaft changes relative to the engine block. While the cylinders of the combustion engine are connected with the engine block, the pistons of the combustion engine moveably guided in the cylinders are connected via piston rods of constant length with the crankshaft. A change of the position of the crankshaft relative to the engine block results also in a change of the position of the pistons in the cylinders of the combustion engine. In particular, the position of the upper dead center (OT) of the pistons in the cylinders changes. As a result, the compression volume VK enclosed via the pistons in the upper dead center position also changes. Since the lower dead center position of the pistons change in the same manner as the upper dead center position, the displaced volume VH of the combustion engine does not change with a change of the crankshaft position relative to the engine block. The change of the compression volume VK with constant displaced volume VH implies a change of the compression ratio $\epsilon=(VH+VK)/VK$.

Alternatively to this adjustment mechanism, in which the distance between the crankshaft bearing and cylinder is controllably changed, also systems are known, in which the compression ratio is changed by means of a tilting of the engine block relative to the crankshaft bearing, or by means of tilting the cylinder head relative to the engine block, or by means of raising or lower the cylinder head relative to the engine block in a control manner. All of these methods have in common that the geometric compression ratio $\epsilon=(VK+VH)/VK$ can be changed by means of a controlled changed of the compression volume VK.

In contrast to common combustion engines, which have a fixed compression ratio $\epsilon$ determined by means of the geometry of the combustion chamber, with a variable compression, the thermodynamic efficiency of the combustion engine can increase in partial-load operational range. As a result, consumption advantages can be achieved. Also, a reduction of the $CO_2$ emission is connected with this. The higher the compression ratio, the higher the compression final temperature will be. Because with increasing compression temperature, the danger increases that knocking combustions occur, the maximum possible compression ratio is limited by the predisposition to knocking of the fuel that is used.

With common combustion engines with fixed compression ratios, the maximum compression ratio is constructively fixed, such that with maximum combustion chamber filling (full load), still no knocking occurs. As a result, with a constructively predetermined compression ratio and combustion chamber filling below a maximum possible value (partial load), critical compression temperatures are not reached easily. The efficiency of the combustion falls below an optimal efficiency. With the variable compression, this efficiency loss can be counteracted. Typically, the geometric compression ratio of a combustion engine is increased with variable compression with increasing load (combustion chamber filling).

With the above-noted DE 199 50 682 A1, a correction of the adjusted compression ratio takes place as a function of signals of a knock sensor of the combustion engine. From the actual angle of ignition, with which the knocking combustion occurs, the direct adjusted compression of the combustion engine should be closed. This teaching, however, does not take into consideration that the occurrence of the knocking combustion is dependent on further parameters, of which, for example, the fuel quality and the intake temperature should be noted. A reliable association of knocking combustions to a determined value of the compression, therefore, is not possible. In addition, for a reliable determination of the compression on the basis of signals of a knock sensor, multiple knocking combustions are necessary, which, based on noise comfort levels and mechanical performance of the combustion engine, is undesirable.

Based on the above concerns, an object of the present invention is to provide a method for adjusting the compression of a combustion engine with variable compression, which is not associated with the above disadvantages. In addition, the objection of the present invention is to provide a device for adjusting the compression which eliminates the above disadvantages.

This object is resolved according to the method of the present invention, which includes the step of correcting the step of determining an actual value of the compression ratio.

In addition, this object is resolved with a device of the above-mentioned type, which includes a control apparatus, which determines from the signals of the sensor mechanism an actual value of the compression ratio and controls the controller as a function of the actual value.

SUMMARY OF THE INVENTION

With the above features, the object of the present invention is resolved completely. The determination of the actual value of the compression permits regulation of the compression in a closed control loop. The disadvantages of the known controlling of the actuator of the compression on the basis of an open timing chain thereby are minimized. With the complexity of the total system of a combustion engine with the plurality of parameters responsible for the occurrence of knocks (compression ratio, fuel quality, intake temperature, ignition time point, . . . ), the confirmation permits a better association of knocking combustions to the causally responsible parameters, and therewith, a targeted countermeasure.

While with the state of the art, it cannot be distinguished whether a knocking was released as a result of an inaccuracy of the compression increased by the actuator or by a premature ignition, the present invention permits such a distinction. With the above-described state of the art according to DE 199 50 682, the occurrence of knocking combustion is countered by means of a correction of the compression. The compression, then, is also reduced when a premature ignition is responsible for the occurrence. The non-optimal efficiency caused by the premature ignition is then further impaired under certain circumstances by a reduction of the compression, which reduces the efficiency. In conclusion, the total efficiency of the combustion engine is reduced by changing a non-causative parameter.

The present invention, in contrast, permits a correction of the compression when the compression is responsible causally for the occurrence of knocks. In conclusion, a combustion engine with variable compression can be driven with improved efficiency, which is advantageous for performance as well as for exhaust quality.

It is preferred that the step of determining the actual value includes an evaluation of signals of at least one combustion chamber pressure sensor.

The use of a combustion chamber pressure sensor permits a direct determination of the compression ratio on the basis of a thermodynamic correlation. In this manner, the compression can be determined accurately and reproducibly.

It is also preferred that the step of determining the actual value includes an evaluation of a chronological trend of the signal of the combustion chamber sensor.

The evaluation of the time response permits elimination of unknown parameters in the thermodynamic correlation and makes possible therewith a determination of the compression from the pressure progression without knowledge of the noted unknown parameters.

It is also preferred that the evaluation of the chronological trend takes place on the basis of a rotation-angle discrete sensing and detection of at least two values of the output signals of the combustion chamber pressure sensor.

This embodiment makes possible the elimination of the unknown parameters already from a pressure progression reduced to two measured values.

Further, it is preferred that as a measurement for the actual value of the compression ratio, a compression final volume VK is determined with a fixed displaced volume VH. Therefore, it is preferred that the compression final volume VK is determined according to the following equation:

$$VK = \frac{(V2 * P2^{1/n} - V1 * P1^{1/n})}{P1^{1/n} - P2^{1/n}}$$

This embodiment permits a concise calculation of the compression ratio that can be performed in real time on the basis of a thermodynamic correlation.

In connection with the device of the present invention, it is preferred that the sensor mechanism has at least one combustion chamber sensor and that the control apparatus determined the actual value from signals of the at least one combustion chamber pressure.

It is also preferred that the control apparatus evaluates the chronological trend of the signals of the combustion chamber pressure sensor.

Further, it is preferred that the control apparatus controls at least one of the above-noted methods.

The same advantages as noted with regard to the method of the present invention also are associated with the device of the present invention.

Further advantages are provided in the following description and attached figures.

It is to be understood that the features described above and to be described in greater detail below are not only useable in the provided combination, but also in other combinations or alone, without deviating from the frame of the present invention.

DETAILED DESCRIPTION OF THE PREFERRED EMBODIMENTS

Figure 1:
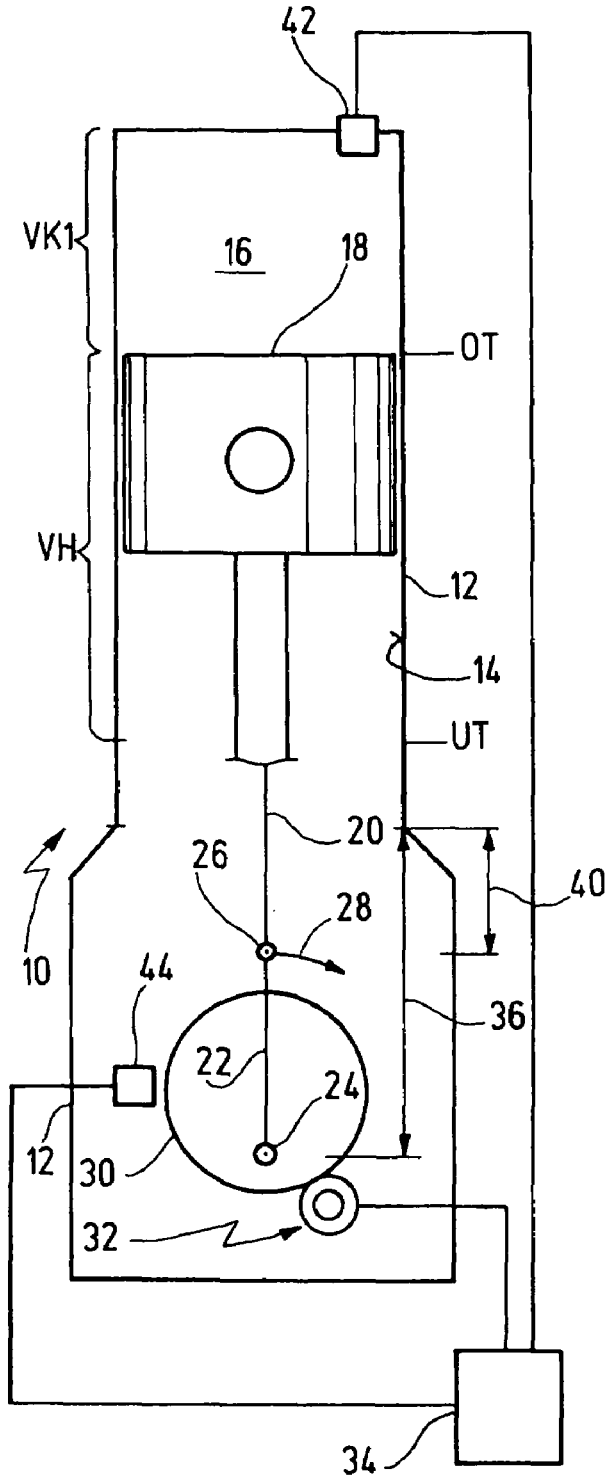
FIG. 1 shows a schematic illustration of a combustion engine with a closed control circuit for regulating a variable compression ratio in a state of lower compression.

In FIG. 1, a combustion engine 10 is shown in markedly simplified form. The combustion engine 10 has an engine block, in which the cylinders 14 are arranged. FIG. 1 shows a cylinder 14 of a multiple-cylinder combustion engine. The remaining cylinders, for example, are arranged behind the shown cylinder 14, so that FIG. 1 corresponds to a schematized front view of a multi-cylinder in-line engine. In the cylinder 14, a combustion chamber 16 is movably sealed up by a piston 18, whereby the piston 18 is guided into the cylinder. The piston 18 is connected via a piston rod 20 to a piston rod bearing 26 of a crankshaft 22, which is rotatably supported in main bearings 24. The arrow 28 indicates the rotational direction of the crankshaft 22. For realization of a variable compression, the main bearings 24 of the crankshaft 22 are not supported directly in the engine block 12, rather in eccentric rings 30.

The eccentric rings 30 are rotatably supported in the engine block 12. The main bearings 24 of the crank shaft 22 are eccentrically mounted in the eccentric rings 30. Thus, the main bearings 24 of the crankshaft 22 are displaced with a rotation of the eccentric rings 30 relative to the engine block 12. In FIG. 1, the main bearing 24 of the crankshaft is located in its lowest possible position. In addition, the crank drive from the crankshaft 22 and piston rod 20 are located in a position, which define the upper dead center OT of the piston 18 in the cylinder 14. The volume above the piston 18 remaining in the upper dead center OT of the piston 18 in the cylinder 14 is designated as the compression volume VK.

In the representation of FIG. 1, a comparably large compression volume VK appears as a result of the lowest possible position of the crankshaft 22 in the engine block. The displaced volume VH of a cylinder 14 of the combustion engine 10 corresponds to the volume, which releases the piston 18 with its movement from the upper dead center OT to the lower dead center UT. This displaced volume VH is not affected by a possible crankshaft displacement by rotation of the eccentric ring 30 and therefore is invariant relative to a displacement of the crankshaft 22.

The geometric compression ratio $\epsilon$ of the combustion engine, as generally known, is the sum standardized from the displaced volume VH of the displaced volume VH and compression volume VK. In the representation of FIG. 1, the numeral 32 represents an actuating element, with which the rotational position of the eccentric ring 30 can be changed in a manner, which is predetermined by means of a control apparatus 34. The actuating element 32, for example, can be an electrically motorized gear, which is cooperatively coupled via a gear drive or worm gear with the eccentric ring 30. As previously noted, the crankshaft 22 is located in FIG. 1 in its lowest possible position relative to the engine block 12. With this lowest possible position of the crankshaft 22, the maximum possible combustion volume VK1 is provided. FIG. 1 represents, therefore, a combustion engine 10 with variable compression in a state of a maximal, lowest compression ratio.

A combustion chamber pressure sensor 42 produces combustion chamber pressure signals, which are supplied to the control apparatus 34. The angular position of the crankshaft 22 is detected by a rotational angle sensor 44. The control apparatus 34 senses the signal of the combustion chamber pressure sensor 42 based on the rotational angle information from the rotational angle sensor 44 to a predetermined angular position of the crankshaft 22. Combustion chamber pressure sensors are known, for example, from DE 199 41 932 A1 of the Applicant.

The control apparatus operates, among other things, as a regulator for the compression ratio, in which it calculates from values of the combustion chamber pressure signal an actual value for the compression ratio, compares this with a theoretical value, and on the basis of the control deviation thus formed, forms and provides a control variable for controlling the actuating element 32. The control apparatus 34, as regulating, actuating element 34, the combustion engine 10 as a control path, and combustion chamber pressure sensor 42 as a control sensor therefore form a closed circuit for regulating the compression. This control circuit can superimpose an anticipatory control, in which an anticipatory control value is formed for the actuating element control.

Figure 2:
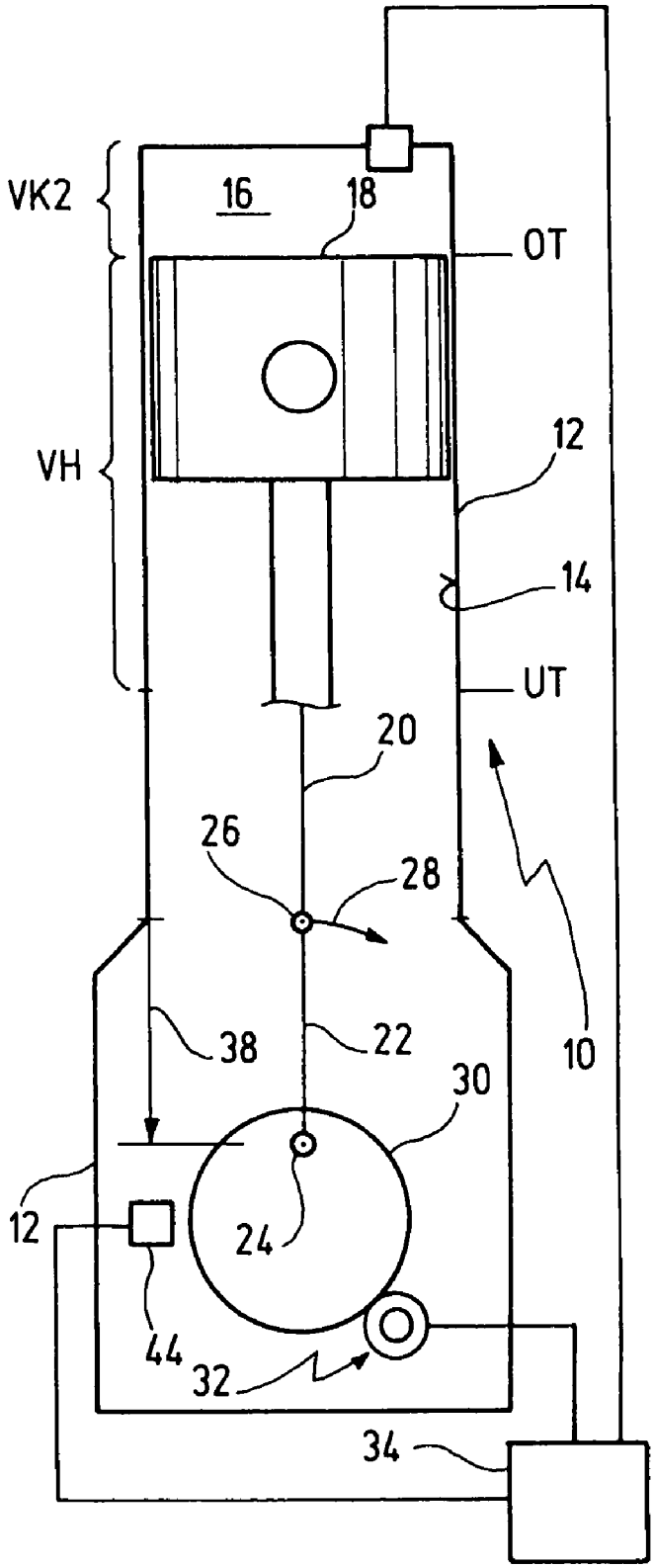
FIG. 2 shows the combustion engine of FIG. 1 in a state of increased compression.

FIG. 2 shows the combustion engine 10 with variable compression from FIG. 1 in a state with the highest possible compression ratio. Unlike FIG. 1, the main bearings 24 of the crank shaft 22 are located in FIG. 2 in the highest possible position relative to the engine block 12. In this manner, the compression volume VK is reduced compulsorily to a minimal value VK2.

The relative position of the main bearing 24 of the crankshaft 22 to the engine block 12 is represented in FIG. 1 by the length of the arrow 36. In FIG. 2, the length of the arrow 38 represents the relative position of the main bearing 24 of the crankshaft 22 in the engine block 12. Arrow 40 represents as the difference of the lengths of the arrows 36 and 38 the extent of the crankshaft displacement between FIGS. 1 and 2. Also, the dead center UT, OT of the movement of the piston 18 in the cylinder shifts to the extent of the length of the arrow 40. On this basis, the compression volume VK closed in the cylinder 14 changes proportionally to the displacement of the crankshaft 22.

Figure 3:
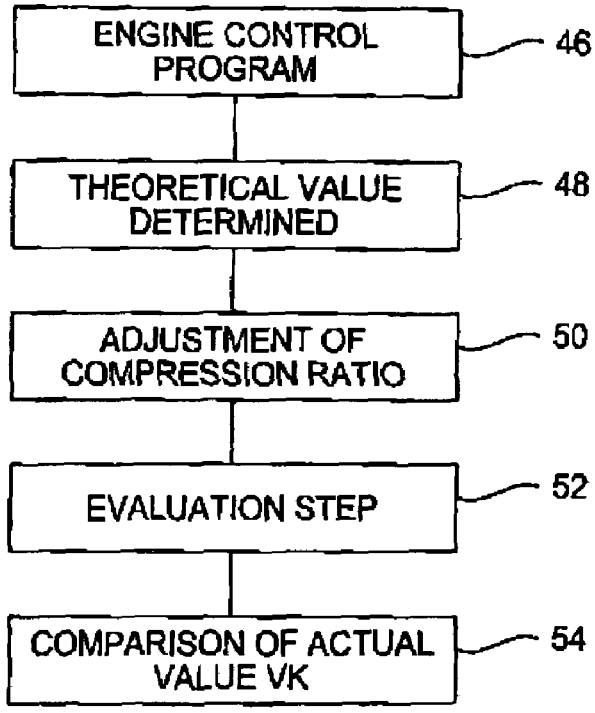
FIG. 3 shows a flow diagram as an example of a method of the present invention.

FIG. 3 shows an embodiment of the method of the present invention. The block 46 represents a superordinate program for controlling the combustion engine 10, which is processed in the control apparatus 34. The main program for engine control includes the control of all functions of the combustion engine 10, that is, for example, the calculation and triggering of ignitions as well as the calculation and a measurement of fuel over injection valves. From this known engine control program of block 46, a step 48 is reached, in which a theoretical value for the compression ratio of the combustion engine 10 is determined. This theoretical value typically is dependent on parameters, which are available anyway in the control apparatus 34 for controlling the remaining combustion engine functions. For example, such parameters are the actual torque requirements of the driver or by other combustion engine functions and the rotational speed of the combustion engine 10.

On the basis of this theoretical value, in step 50, the compression ratio is adjusted to the theoretical value formed in step 48. In the sense of an anticipatory control (open timing chain), a control signal for the actuating element 32 can be formed, which permits a quick adjustment of the compression in the direction of the desired theoretical value. An actual value for the actual compression ratio is formed from signals of the at least one combustion chamber pressure sensor 42. In this manner, the known fact is formed that a correlation between cylinder pressure and cylinder volume can be provided by the polytropic constitutive equation as follows, the basis for the formation of an actual value for the compression from signals of the combustion chamber pressure sensor 42:

$$p_i \cdot V_i^n = K = \text{constant}$$

The index i corresponds therefore to a sensing of the signal of the combustion chamber pressure sensor 42 at a predetermined angular position of the crankshaft 22. This correlation applies during the phase of the working cycle of the combustion engine 10, in which the gas volume is closed in the combustion chamber 16 of the combustion engine 10 and no energy conversion takes place by means of a combustion.

For example, these phases are the compression phase in the compression cycle before initiating of a combustion and the phase of the expansion at the end of the working cycle after termination of the combustion. The exponent n depends essentially on the composition of the gas in the combustion chamber 16 and the heat transfer from the gas to the environment, that is, at the walls of the combustion chamber 16.

The constant K is not known generally. In the frame of one embodiment of the present invention, this constant, however, can be eliminated by means of an evaluation of the chronological trend of the pressure in the combustion chamber 16, whereby the chronological trend of the pressure already can be derived from two angular-discrete, recorded combustion chamber pressure values. Depending on the manner of operation of the combustion engine 10, different, but known values for n are provided. With compression of a fuel-air mixture, that is, a mixture-compressing type of operation, n is approximately equal to 1.32. With air-compressing types of operation, n is approximately equal to 1.37.

An air-compressing type of operation, for example, is provided by the shift operation of a combustion engine with direct injection before the ignition, while with the homogenous operation of such a combustion engine, in which a direct injection takes place already earlier in the compression cycle, an example of a mixture-compressing type of operation is represented. In one form of the present invention, according to the type of operation, different values for n are used. The volume V of the above-provided polytropic equation is composed of the displaced volume VH and the compression volume VK in the case of the combustion engine 10. For the pressure P1 affiliated with a first crankshaft angle, the correlation is provided that the product of P1 and the $n^{th}$ power of the sum of the displaced volume VH1 associated with the first crankshaft angular position and the compression volume VK corresponds with the constant K.

For a pressure P2 accommodated within the same increase of the combustion chamber pressure of a drop of the combustion chamber pressure with a second crankshaft angular position, analogously the same correlation is provided, that is, that the product of P2 and the $n^{th}$ power of the sum associated with the second crankshaft angular position of the displaced volume VH2 and compression volume VK corresponds to the constant K. Equating the two equations for P1 and P2 and solving according to VK, then, runs the following equation for determining the compression volume VK:

$$VK = \frac{(VH2 * P2^{1/n} - VH1 * P1^{1/n})}{P1^{1/n} - P2^{1/n}}$$

The combustion chamber pressure signal is already affected with an objectionable noise from the signal processing. A solution of the above-provided polytropic equation according to the compression volume VK for an individual pair of pressures P1, P2 also can be replaced for improvement of the signal/noise ratio, such that more than two pairs of pressure-volume values are used. In this manner, the quality of the calculation can be improved. In this connection, in a first method, an n-tuple of values VK1 . . . VKn can be determined from n value pairs. Subsequently, in the frame of the first method, the mean value of the values VK1 . . . VKn is calculated and used as the input value for the further calculation.

Alternatively, from the m polytropic equation, a linear equation system can be compiled and solved for VK, whereby VK in the sense of a minimal quadratic measurement of error is determined.

In other words, the combustion pressure is sensed at fixed crankshaft angular positions, and the result of the measured values is stored as a data result. Subsequently, in evaluation step 52, the compression volume VK is determined with the known values of the combustion chamber volume in the determined crankshaft angular positions and the detected values of the combustion chamber pressure.

Subsequently, in step 54 of FIG. 3, a comparison of the actual value for VK determined in this manner with the theoretical value for VK determined in step 48 and the formation of a corrective signal as the regulating means for the control of the actuating element 32 takes place. In other words, the compression volume VK is used with a fixed displaced volume VH as a measurement of the actual value of the compression ratio. Alternatively, of course, also the compression ratio can be determined from the values of VK and VH and serves as input parameters for the described control circuit.

Figure 4:
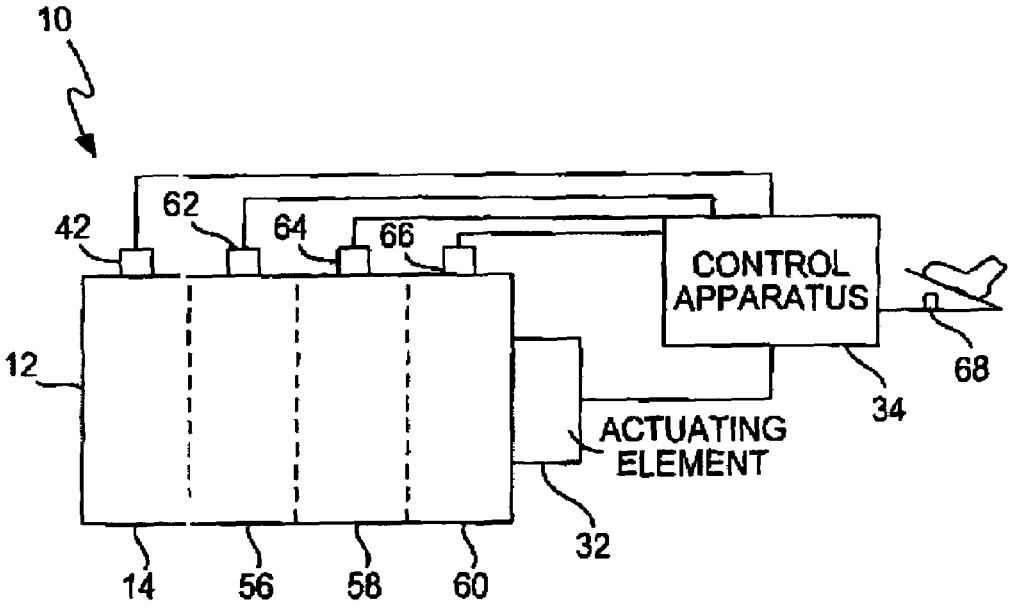
FIG. 4 shows a combustion engine with multiple cylinders and cylinder-individual combustion chamber pressure sensors with a closed control circuit for regulating a variable compression ratio.

FIG. 4 shows a combustion engine with four cylinders 14, 56, 58, and 60 and four individually associated combustion chamber pressure sensors 42, 62, 64, and 66. These combustion chamber pressure sensors 42, 62, 64, and 66 are connected with the control apparatus 34, which in addition, contain input signals of further signals, for example, the signal of an accelerator sensor 68 and the signal of the angular sensor 44, which can be evaluated also for determination of the rotational speed of the combustion engine relative to the rotational speed of its crankshaft 22. Such an arrangement permits a cylinder-individual regulation of the compression ratio, in so far as the actuating element 32 also can work in a cylinder-individual manner.

With a non-cylinder-individual manner of operation of the actuating element 32, the arrangement with cylinder-individual combustion chamber pressure sensors 42, 62, 64, and 66 can serve to identify exactly the cylinder, with which, based on mechanical deviations, the cylinder and actuating element drive adjust among themselves the largest or smallest compression. Subsequently, the control of the compression preferably is made on the basis of the fixed extreme value. In this manner, for example, the particular cylinder can be identified, which, based on the largest compression, declines the soonest to knocking combustions. Then, when the subsequent control of the compression takes place in a cylinder-comprehensive manner on the basis of this cylinder that is sensitive in a way, it is also possible that the remaining cylinders are not driven, which could lead to knocking combustions.

It will be understood that each of the elements described above, or two or more together, may also find a useful application in other types of constructions differing from the types described above.

While the invention has been illustrated and described herein as a method and device for adjusting a variable compression in a combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A method for operating a combustion engine (10) with a variable compression ratio, comprising the following steps:

determining a theoretical value for the compression ratio;

adjusting the compression ratio to the theoretical value;

correcting the adjusted compression ratio as a function of signals of a sensor mechanism of the combustion engine, wherein the step of correcting includes the step of determining an actual value of the compression ratio, wherein the step of determining the actual value includes an evaluation of signals at least of one combustion chamber pressure sensor and an evaluation of a chronological trend of the signals of the at least one combustion chamber pressure sensor, wherein the evaluation of the chronological trend take place on the basis of an angle of rotation-discrete scanning and detection of at least two values of output signals of the at least one combustion pressure sensor, and wherein as a quantity for the actual value of the compression ratio, a compression final volume VK is determined with a fixed displaced volume VH.

2. The method according to claim 1, wherein the compression fina volume VK is determined according to the equation:

$$VK = \frac{(VH2 * P2^{1/n} - VH1 * P1^{1/n})}{P1^{1/n} - P2^{1/n}}.$$

3. A device for operating a combustion engine, comprising:

at least one actuating element for adjusting a variable compression ratio to a theoretical value and a sensor mechanism, wherein the sensor mechanism is sensitive to changes of the compression ratio;

a control apparatus, wherein the control apparatus determines repeatedly an actual value of the compression ratio and controls the at least one actuating element as a function on the actual value, wherein the determination of the actual value includes an evaluation of a chronological trend of signals at least of one combustion chamber pressure sensor, wherein the evaluation of the chronological trend take place on the basis of an angle of rotation-discrete scanning and detection of at least two values of output signals of the at least one combustion pressure sensor, wherein as a quantity for the actual value of the compression ratio, a compression final volume VK is determined with a fixed displaced volume VH.

* * * * *